United States Patent [19]

Dufour

[11] 4,356,225

[45] Oct. 26, 1982

[54] PAPERMARKERS INTERWOVEN WET PRESS FELT

[75] Inventor: Marcel Dufour, Sryrieix, France

[73] Assignee: Ascoe Felts, Inc., Clinton, S.C.

[21] Appl. No.: 264,334

[22] Filed: May 18, 1981

[51] Int. Cl.[3] ..... B32B 5/06

[52] U.S. Cl. ..... 428/234; 34/243 F; 139/383 A; 428/238; 428/239; 428/247; 428/257; 428/258

[58] Field of Search ..... 428/234, 238, 239, 247, 428/257, 258, 259; 139/383 A; 34/243 F

[56] References Cited

U.S. PATENT DOCUMENTS

| | | | |
|---|---|---|---|
| 2,947,328 | 8/1960 | Asten et al. | 139/412 |
| 3,613,258 | 10/1971 | Jamieson | 34/95 |
| 4,283,454 | 8/1981 | Buchanan | 428/257 |

FOREIGN PATENT DOCUMENTS 2003948 3/1979 United Kingdom .

*Primary Examiner*—Marion McCamish
*Attorney, Agent, or Firm*—Benasutti Associates, Ltd.

[57] ABSTRACT

A papermaker's wet felt having improved structural stability and void volume is disclosed. The fabric is at least three ply in construction and is constructed without binder yarns or adhesives.

13 Claims, 4 Drawing Figures

PAPERMARKERS INTERWOVEN WET PRESS FELT

BACKGROUND OF THE INVENTION

1. Field of the Invention

This invention relates to fabric for use on a papermaking machine. The fabric is particularly suited to use in the wet press portion of a papermaking machine.

2. Brief Description of the Prior Art

The prior art includes a number of attempts to define a weave construction which is suitable for use as a wet press felt in a papermaking machine. All of the prior art attempts recognized the desirability of maintaining a controlled void volume within the fabric construction. The void volume is of particular value in the wet press section in that it directly contributes to controlling the amount of rewetting which takes place after the fabric has passed through the press rollers.

An example of prior art attempts to control the void volume of the fabric may be seen in U.S. Pat. No. 4,224,372. This patent discloses a fabric which includes a synthetic polymeric thermoplastic resin foamfill which is introduced into the fabric in order to control the void volume.

Another prior art attempt to control the void volume may be seen in U.S. Pat. No. 4,187,618. This patent discloses a papermaker's felt having drainage channel yarns disposed along the bottom surface thereof and secured thereto by binder yarns.

Another prior art attempt to control void volumes is seen in U.S. Pat. No. 4,182,381. Although this patent does not disclose a fabric which is directly concerned with void volumes, it does disclose a patent which uses the interweaving of warp yarns in an attempt to add additional weft yarns to reduce the voids in the fabric and increase the fabric density in the area of a pin seam.

Another prior art patent which is of interest in U.S. Pat. No. 2,949,134. This patent discloses a number of weave patterns for a triply papermaker's felts. The disclosed weave patterns are disclosed as being beneficial when constructed with a fibrous material which is electro negative. This patent does recognize the necessity for maintaining the void volumes, and in particular recognizes the necessity for preventing the voids from being clogged with pitch, cellulose fibers, china clay and other materials present in the stock from which paper is made.

Another prior art patent which is of interest in U.S. Pat. No. 1,834,343. This patent discloses a dryer felt as opposed to a wet press felt, however, it does recognize the need to provide intervals across the cloth which are open or porous which will provide more ready passes or escape for the steam or vapor generated in the drying of the fabric. The fabric is described as consisting of a construction of a multi-ply fabric for drying felts with a dense intermediate layer in which the warps are crowded laterally into compact dense groups divided by spaces devoid of or thereby forming a multi ply fabric with longitudinal sections of compact dense formation alternating with longitudinal sections devoid of warp and of an open or porous formation.

Another prior art reference which is directed to the dryer felts is U.S. Pat. No. 1,801,081. This patent discloses a fabric which is described as a dryer felt so constructed to have an open or cellular porous layer on each surface, with a dense intermediate layer into which additional warp threads are crowded interwoven and interlocked with one layer of weft threads thereby providing a high density factor which limits the possible shrinkage in width.

SUMMARY OF THE INVENTION

The instant invention provides a papermaker's wet press felt for use in the wet press section of a papermaker's machine. The disclosed papermaker's wet press felt is particularly adapted to provide a controlled void volume and increased fabric stability. The disclosed wet press felt comprises a base fabric of at least a three layer construction having the machine direction yarns of the respective layers maintained in a generally vertical orientation with respect to each other and the cross machine direction yarns interwoven with the machine direction yarns in a weave repeat that unites the multiple layers into a single base fabric having an increased stability as a result of the weave repeat. A batt is needled to the base fabric to produce the final papermaker's wet felt.

It is an object of the invention to provide a papermaker's wet felt having controlled void volumes and increased fabric stability.

DESCRIPTION OF THE PREFERRED EMBODIMENT

Referring now to the attached drawings, the invention will be described in more detail with like numerals indicating like elements in all Figures.

Figure 1:
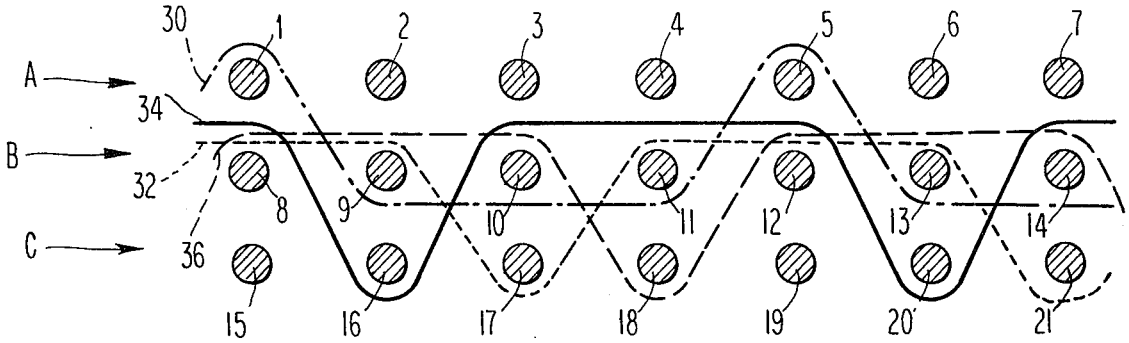
FIG. 1 is a schematic diagram of the weave of the base fabric according to the instant invention.

With reference to FIG. 1, there is illustrated a three ply fabric having machine direction yarns 1 through 21 inclusive arranged in three plies or layers. Machine direction yarns 1 through 7 form layer A, machine direction yarns 8 through 14 form layer B and machine direction yarns 15 through 21 form layer C. There are eight cross machine direction yarns within the weave repeat of the instant fabric, however, for clarity four cross machine direction yarns 30, 32, 34, and 36 will be illustrated in FIG. 1 to describe the weave pattern. The remaining four cross machine direction yarns will be described as to their interweavings and will enable those skilled in the art to weave the instant fabric.

Cross machine direction yarn 30 weaves over yarn 1, drops between yarns 1 and 2 and drops into layer B, floats under yarns 9, 10 and 11 of layer B, passes between yarns 11 and 12, rising back to layer A, around yarn 5, passes between yarns 5 and 6 and drops to layer B where it floats under yarns 13 and 14 before rising to layer A for another repeat.

Cross machine direction yarn 32 which originates in layer B, floats over yarns 8 and 9, passes between yarns 9 and 10 and drops into layer C, passes beneath yarn 17, then passes back up between yarns 17 and 18, rises into layer B, floats over yarns 11, 12 and 13, passes between yarns 13 and 14 and drops to layer C passing under yarn 21.

Cross machine direction yarn 34, which originates in layer B, floats over yarn 8, passes between yarns 8 and 9 and drops to lower layer C, passes around yarn 16, passes between yarns 16 and 17 and rises back to layer B where it floats over yarns 10, 11 and 12, passes between yarns 12 and 13 and drops to layer C where it passes around yarn 20, passes between yarns 20 and 21 and rises back into layer B and floats over yarn 14.

Cross machine direction yarn 36 which originates in layer B, floats over yarns 8, 9 and 10, passes between yarns 10 and 11 and drops to layer C where it passes around yarn 18, passes between yarns 18 and 19, rising into layer B where it floats over yarns 12, 13 and 14.

The fifth cross machine direction yarn, not shown for purposes of clarity of the drawing, originates in a layer B, floats under yarn 8 between yarns 8 and 9 rising to a layer A and around yarn 2, passes between yarns 2 and 3 and drops into layer B where it passes under yarns 10, 11 and 12, passes between yarns 12 and 13 rising to layer A where it passes around yarn 6 and drops to layer B where it floats under yarn 14.

The sixth cross machine direction yarn, again not shown for purposes of clarity, originating in layer B, floats under yarns 8 and 9 between yarns 9 and 10, rising to layer A where it passes around yarn 3, dropping to layer B where it passes under yarns 11, 12 and 13, passes between yarns 13 and 14 rising to layer A where it passes around yarn 7.

The seventh cross machine direction yarn, again not shown for purposes of clarity, originating in layer B, passes under yarns 8, 9 and 10 between yarns 10 and 11, rising to layer A where it passes around yarn 4, dropping into layer B where it floats under yarns 12, 13 and 14.

The last remaining cross machine direction yarn, again not shown for purposes of clarity, originating in layer C passes around yarn 15, rising up to layer B where it floats over yarns 9, 10 and 11, passes between yarns 11 and 12 dropping to layer C where it passes around yarn 19, rising back into layer B where it floats over yarns 13 and 14.

By reference again to FIG. 1, it can be seen by tracking the cross machine direction yarns 30, 32, 34, and 36 that the vertically arranged machine direction yarns are influenced so as to stack vertically. This may be clearly understood by referring to machine direction yarns 9, 10 and 11. Note that cross machine direction yarn 30 floats under machine direction yarns 9, 10 and 11 and as will be known to those in the art, the influence of machine direction yarns 1 and 5 will tend to draw yarns 1 and 5 and 9, 10 and 11 into a single plane. However, due to the weave pattern of yarn 32, yarn 9 of layer B will also be influenced or drawn into a common plane with yarn 17 of layer C as a result of the weave pattern of yarn 32. Also note that as a result of the yarn 30 floating under yarn 9 and yarn 32 floating thereover there are horizontal forces which tend to keep yarn 9 in a flxed vertical position. Referring now to machine direction yarn 10 it can be seen that it like yarn 9 will be influenced towards a common plane with yarns 1 and 5, however, due to the weave pattern of yarn 32 and yarn 36, yarn 10 will be influenced toward a common plane with yarns 16 and 18 of layer C. Likewise note that the yarns 34 and 36 may cause of the opposite direction of float and yarn tension will also tend to maintain yarn 10 in a stable horizontal position. Yarn 11 like yarn 9 is influenced by the weave patterns of cross machine direction yarn 30 and 32 and therefore will be stabilized as to horizontal and vertical positioning. Yarn 34 although it floats over yarn 11 will not adversely affect the stable horizontal or vertical position.

Figure 2:
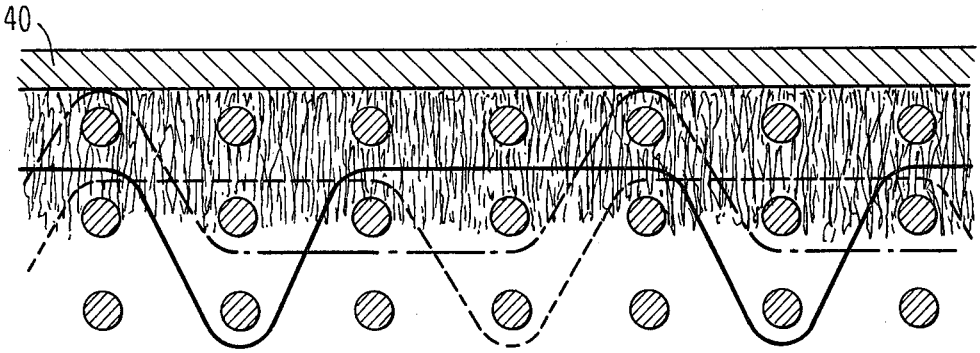
FIG. 2 is a schematic diagram of the base fabric according to the instant invention having needled thereon a batt which forms the paper-carrying surface.

It is important to recognize that the wet felt of the instant invention eliminates the need for adhesives or binder yarns to define the void volume channels. The elimination of adhesives or binder yarns provides a more controllable void volume and prevents production problems associated with the breaking or flaking of adhesives and the breaking or rupture of binding yarns. Owing to the fact that in the preferred embodiment the base fabric is woven almost exclusively of continuous monofilament or multifilament yarns, it is frequency not desirable to use the base fabric as a papermaking fabric due to the marking characteristics of the fabric. However there may be applications where the marking characteristics of the fabric will not adversely affect the product and in those applications the base fabric may be used in its disclosed form. However, it has been found that frequently an improved surface characteristic is desired for the fabric. To that end, there is shown in FIG. 2 the base fabric of FIG. 1 having needled thereto a batt 40. Batt 40 as will be known to those skilled in the art, may be made of different materials and density according to end product application. The batt 40 is needled to the base fabric using techniques known in the art.

Figure 3:
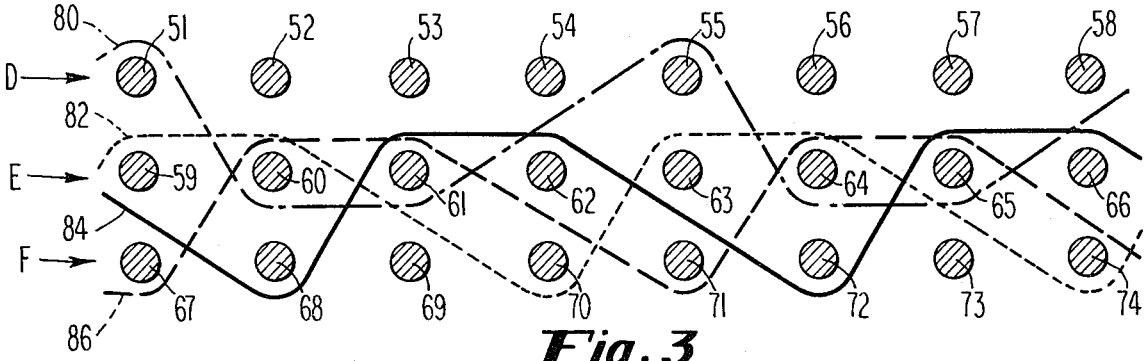
FIG. 3 is a schematic diagram of the weave an alternative base fabric according to the instant invention.

An alternative construction for the base fabric for the instant invention is illustrated in FIG. 3. As previously discussed with reference to FIG. 1, the illustration in FIG. 3 is a schematic diagram of the weave construction. The schematic diagram of FIG. 3 illustrates a repeat of 24 machine direction yarns. The machine direction yarns 51 through 74 are arranged in three plies or layers as previously described. Machine direction yarns 51 through 58 lie in layer D, machine direction yarns 59 through 66 lie in layer E, and machine direction yarns 67 through 74 lie in layer F. The cross machine direction yarns repeat on a weave of eight cross machine direction yarns, however as previously discussed for the purposes of clarity, only four cross machine direction yarns 80, 82, 84 and 86 are illustrated on the diagram. The remaining cross machine direction yarns will be described as to the weave pattern but will not be illustrated.

Again with reference to FIG. 3, cross machine direction yarn 80, originating in layer D weaves around yarn 51, descends into layer E and floats under yarns 60 and 61, passes between yarns 54 and 62 and rising to layer D where it weaves around yarn 55, descending to layer B and weaving under yarns 64 and 65 and weaving between yarns 58 and 66 as it rises back into layer D.

Cross machine direction yarn, originating in layer E floats over yarns 59 and 60, passes between yarns 61 and 69 while descending into layer F, weaves around yarn 70 and ascends back into layer E where it floats over yarns 63 and 64, passes between yarns 65 and 73 as it descends into layer F where it weaves around yarn 74 and rises back into layer E.

Cross machine direction yarn 84, originating in layer E passes between yarns 59 and 67, weaves around yarn 68 and rises into layer E where it floats over yarns 61 and 62 before passing between yarns 63 and 71 on its descend back into layer F where it weaves around yarn 72 and rises back into layer E where it weaves over yarns 65 and 66.

Cross machine direction yarn 68, originating in layer F, weaves around yarn 67 and rises into layer E where it floats over yarns 60 and 61 before passing between yarns 62 and 70 on its descent into layer F where it weaves around yarn 71 and rises back into layer E where it floats over yarns 64 and 65 before passing between yarns 66 and 74 on its descent to layer F.

The fifth cross machine direction yarn, not shown for clarity of illustration, originates in layer F, passing between yarns 1 and 9 as it rises into layer D where it weaves around yarn 2 before descending into layer E where it floats under yarns 61 and 62 and passes between yarns 55 and 63 as it rises back into layer D where it weaves around yarn 56 before descending back into layer E and floating under yarns 65 and 66.

The sixth cross machine direction yarn, again not shown for purposes of clarity, originating in layer E, weaves around yarn 9, passes between yarns 52 and 60 on the rise to layer D where it weaves around yarn 53 and descends into layer E where it floats under yarns 62 and 63 before passing between yarns 56 and 64 on the rise to layer D where it weaves around yarn 57 and passes through yarns 58 and 66 on its descent into layer E.

The seventh cross machine direction yarn, again not shown for purposes of clarity, originating in layer E, floats under yarns 59 and 60, passes between yarns 53 and 61 on the rise to layer D where it weaves around yarn 54 and descends into layer E where it floats under yarns 63 and 64 before passing between yarns 57 and 65 on the rise to layer D where it weaves around yarn 58.

The final cross machine direction yarn, again not shown for purposes of clarity, originating in layer E, floats over yarn 59 before passing between yarns 60 and 68 on its descent into layer F where it weaves around yarn 69 and rises into layer E where it floats over yarns 62 and 63 before passing between yarns 64 and 72 on its descent into layer F where it weaves around yarn 63 and rises back into layer E where it floats over yarn 66.

As can be seen by referring to FIG. 3 the weave pattern will produce a base fabric having cross machine direction yarns aligned in a vertical manner and stabilized in the vertical and horizontal directions. With reference to yarns 60 and 61 it can be seen that cross machine direction yarn 80 will tend to pull the yarns 60 and 61 upwardly to the plane of layer D as a result of the interweaving of yarns 51 and 55. However, yarns 60 and 61 will tend to be drawn toward the plane of layer D as a result of the interweaving of cross machine direction yarn 86 with yarns 67 and 71. The interweaving of cross machine direction yarn 82 will tend to draw the yarn 60 downwardly and toward yarn 59 while cross machine direction yarn 84 will tend to draw the yarn 61 downwardly into the plane of layer F and toward yarn 62. As a result of the multiple cross machine direction yarn influences acting upon them, yarns 60 and 61 will be maintained in their vertical position and will be horizontally stabilized as a result of the interplay of the yarns.

Figure 4:
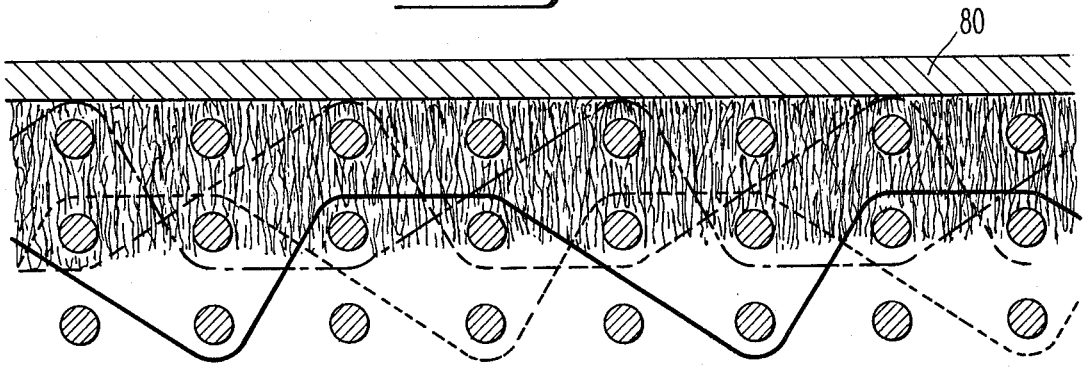
FIG. 4 is a schematic diagram of the base weave according to the alternative embodiment having a batt needled thereon which forms the paper-carrying surface.

Referring now to FIG. 4, there is shown the base fabric according to the invention as shown in the alternative embodiment of FIG. 2 with a batt needled thereto. As previously explained for some applications of the fabric the marking characteristics of the fabric will be such that it is desirable to alter the characteristics. In order to achieve these altered characteristics of batt 80 is needled thereto as explained previously.

We claim:

1. A multi-layer papermaker's wet felt comprising:

(a) at least three layers of machine direction yarns, said layers having their respective machine direction yarns aligned vertically; and (b) a plurality of cross machine direction yarns for interweaving said three machine direction layers, each of said cross machine direction yarns weaving in a repeat pattern having interlacings with machine direction yarns in at least two of said machine direction layers, said repeat pattern having floats which extend for at least two machine direction yarns thereby maintaining said machine direction layers in vertical alignment.

2. The fabric of claim 1 wherein said wet felt further comprises:

a batt needled thereto.

3. The fabric of claim 1 wherein:

said repeat pattern has floats which extend for at least three machine direction yarns.

4. The fabric of claim 3 wherein:

said repeat pattern repeats on eight cross machine direction yarns.

5. The fabric of claim 4 wherein said wet felt further comprises:

a batt needled thereto.

6. The fabric of claim 1 wherein:

said repeat pattern repeats on eight cross machine direction yarns.

7. A papermaker's wet felt comprising:

a top layer of machine direction yarns;

a middle layer of machine direction yarns;

a bottom layer of machine direction yarns; and a cross machine system of yarns interwoven with selected floats with said machine direction yarns for maintaining said layers of machine direction yarns in vertical alignment, including a first cross machine sub-system interweaving with said top and middle layers in a repeat pattern having floats adjacent said middle layer extending at least two machine direction yarns; and a second cross machine sub-system interweaving with said bottom and middle layers in a repeat pattern having floats adjacent said middle layer extending at least two machine direction yarns.

8. A papermaker's felt according to claim 7 wherein said cross machine yarn system is interwoven with said machine direction yarn in a repeat of 8 yarns such that each of said sub-systems has a repeat of 4 yarns.

9. A papermaker's felt according to claim 8 wherein said floats of each said cross machine sub-system extend for two machine direction yarns of said middle layer.

10. A papermaker's felt according to claim 8 wherein said floats of each said cross machine sub-system extend for three machine direction yarns of said middle layer.

11. A papermaker's felt according to claim 7 wherein:

the floats of said repeat pattern of said first cross machine sub-system run below said middle layer; and the floats of said repeat pattern of said second cross machine sub-system run above said middle layer of machine direction yarn.

12. A papermaker's felt according to claim 7 wherein the floats of said repeat patterns of said first and second cross machine sub-system are continuous within the repeat of the pattern.

13. A papermaker's felt according to claims 7, 8, 9, 10, 11 or 12 further comprising:

a batt needled to said base.

* * * * *